US008220277B2

(12) United States Patent
Dieckmann et al.

(10) Patent No.: US 8,220,277 B2
(45) Date of Patent: Jul. 17, 2012

(54) DEHUMIDIFICATION METHOD HAVING MULTIPLE DIFFERENT REFRIGERATION PATHS BETWEEN THE REHEAT AND COOLING COILS

(75) Inventors: John T. Dieckmann, Belmont, MA (US); Detlef Westphalen, Roslindale, MA (US)

(73) Assignee: Tiax LLC, Cambridge, MA (US)

( * ) Notice: Subject to any disclaimer, the term of this patent is extended or adjusted under 35 U.S.C. 154(b) by 66 days.

(21) Appl. No.: 11/841,152

(22) Filed: Aug. 20, 2007

(65) Prior Publication Data

US 2008/0104974 A1 May 8, 2008

Related U.S. Application Data

(60) Provisional application No. 60/857,672, filed on Nov. 7, 2006, provisional application No. 60/878,890, filed on Jan. 5, 2007, provisional application No. 60/919,968, filed on Mar. 26, 2007.

(51) Int. Cl.
*F25D 17/06* (2006.01)
*F25D 11/00* (2006.01)
*F25B 1/00* (2006.01)

(52) U.S. Cl. ..... 62/93; 62/89; 62/90; 62/91; 62/92; 62/430; 62/498

(58) Field of Classification Search ..... 62/89–93, 62/430, 498
See application file for complete search history.

(56) References Cited

U.S. PATENT DOCUMENTS 4,350,020 A * 9/1982 Rojey ..... 62/93
4,428,205 A * 1/1984 Doderer ..... 62/93
5,031,411 A * 7/1991 Gehring et al. ..... 62/93
5,036,672 A * 8/1991 Rottmann ..... 62/651
5,228,302 A * 7/1993 Eiermann ..... 62/90
5,275,233 A * 1/1994 Little ..... 165/111
5,277,036 A 1/1994 Dieckmann et al.
5,404,938 A * 4/1995 Dinh ..... 165/113
5,651,258 A * 7/1997 Harris ..... 62/90
5,845,702 A * 12/1998 Dinh ..... 165/104.21
5,921,315 A * 7/1999 Dinh ..... 165/104.21
6,109,044 A * 8/2000 Porter et al. ..... 62/96
6,199,395 B1 3/2001 Dieckmann et al.
6,257,002 B1 7/2001 Dieckmann et al.
6,301,907 B1 * 10/2001 McCollin et al. ..... 62/93
6,324,860 B1 12/2001 Maeda et al.
6,427,454 B1 * 8/2002 West ..... 62/93

(Continued)

OTHER PUBLICATIONS

DuPONT™ SUVA® Refrigerants, "Temperature Glide in DuPont™ Suva® MP, DuPont™ Suva® HP, and DuPont™ Suva® 407C Series Refrigerant Blends," E.I. du Pont de Nemours and Company Technical Bulletin, 2004.

(Continued)

*Primary Examiner* — Marc Norman
*Assistant Examiner* — Filip Zec
(74) *Attorney, Agent, or Firm* — Michael D. Bednarek; Axinn Veltrop Harkrider LLP

(57) ABSTRACT

Recuperation systems and methods are applied to vapor compression cycles in dehumidification, such as in air conditioning. In some embodiments, a method for dehumidification includes introducing a refrigerant from a heating unit to a cooling unit along a first path; introducing the refrigerant from the cooling unit to the heating unit along a second path different from the first path; introducing the refrigerant from the heating unit to the cooling unit along a third path different from the first path; and contacting the cooling unit and the heating unit with a first gas stream.

12 Claims, 15 Drawing Sheets

U.S. PATENT DOCUMENTS

| | | | | |
|---|---|---|---|---|
| 6,481,232 | B2 * | 11/2002 | Faqih | 62/291 |
| 6,490,874 | B2 * | 12/2002 | Chu et al. | 62/93 |
| 6,591,902 | B1 * | 7/2003 | Trent | 165/274 |
| 6,612,119 | B2 * | 9/2003 | Eber et al. | 62/90 |
| 6,957,543 | B1 | 10/2005 | Reznik | |
| 7,234,318 | B2 * | 6/2007 | Grisler | 62/408 |
| 2002/0116934 | A1 * | 8/2002 | Dinnage et al. | 62/93 |
| 2003/0208923 | A1 * | 11/2003 | Lewis | 34/471 |
| 2004/0194478 | A1 * | 10/2004 | Maeda et al. | 62/93 |
| 2004/0206094 | A1 * | 10/2004 | Maeda | 62/93 |
| 2005/0198976 | A1 * | 9/2005 | Wright | 62/93 |
| 2006/0130495 | A1 | 6/2006 | Dieckmann et al. | |

OTHER PUBLICATIONS

Lavelle, Pressure-Temperature Chart, "How to Use a Two-Column Pressure-Temperature Chart," unknown publication date.

* cited by examiner a) With single crossflow refrigerant passes through the precooling and preheating coils.

b) With two crossflow/counterflow refrigerant passes through the precooling and preheating coils.

DEHUMIDIFICATION METHOD HAVING MULTIPLE DIFFERENT REFRIGERATION PATHS BETWEEN THE REHEAT AND COOLING COILS

CLAIMS OF PRIORITY

This application claims priority to U.S. Provisional Patent Application Ser. No. 60/857,672, filed on Nov. 7, 2006; U.S. Provisional Patent Application Ser. No. 60/878,890, filed on Jan. 5, 2007; and U.S. Provisional Patent Application Ser. No. 60/919,968, filed on Mar. 26, 2007, all of which are entitled "Vapor Compression Cycle with Internal Recuperation Using Liquid Refrigerant for Heat Transport". All three applications are hereby incorporated by reference.

TECHNICAL FIELD

The invention relates to dehumidification or removal of moisture.

BACKGROUND

Dehumidification can be important for a variety of applications including comfort, health, industry and manufacturing, defrosting or defogging of windows, collection of water from the air for drinking or other uses, maintenance of frozen food, preservation of building materials and other objects, and prevention of mold, dust mites, and other harmful pests.

Referring to FIG. 1A, in a vapor compression cycle dehumidification system 20, moisture is removed by cooling air 22 to be dehumidified below its dew point, causing moisture to condense out of the air. The air is cooled by a refrigerated cooling coil (an evaporator 24) and moisture condenses on the surface of the coil and drains off the coil by gravity into a condensate pan 26 and is sent to a drain 28. The cooled air 30 is then reheated by passing through a condenser 32 (cooling the condenser in the process).

Referring to FIG. 1B, the performance (both the efficiency and the amount of moisture removed for a given refrigerant compressor capacity) can be improved by using the cooled air 30 leaving evaporator 24 to pre-cool air 22 before it enters the evaporator, i.e., by recuperating, reducing the amount of cooling that is done by the evaporator and a compressor 34. As shown, an upstream coil 36 and a downstream coil 38 relative to evaporator 24 provide the recuperative pre-cooling, with the heat that is removed from incoming air 22 transported by heat pipes 40 to the downstream coil, where it is transferred to cooled dry air 30 leaving the evaporator.

Other methods of recuperation include pumping an independent heat transfer fluid between an incoming air stream and a post evaporator air stream, and directly exchanging heat between an incoming air stream and the air stream leaving the evaporator without the use of a heat transfer fluid.

SUMMARY

The invention relates to dehumidification or removal of moisture.

In one aspect, the performance (e.g., capacity and efficiency) of a vapor compression cycle in a dehumidification system is enhanced by recuperation using a refrigerant flow within the system to transport heat between two portions of a recuperator. For example, in a standalone dehumidifier, cold air exiting an evaporator is used to pre-cool air before the air enters the evaporator, thereby reducing the amount of cooling that is done by the evaporator. This recuperation can be done by a pair of coils (a cooling unit and a heating unit) connected by alternating passes of a refrigerant fluid from a cooling cycle.

The recuperation described herein can also be applied to an air conditioning or heat pumping system. In an air conditioning system, air in an interior space is cooled, while heat is rejected outside the space. Recuperation can be achieved by cooling air to a lower temperature, reducing the evaporating temperature, and optionally incorporating reheat. Adding recuperation to pre-cool air before it enters the evaporator and to reheat it upon exit from the evaporator allows operation with a lower sensible heat ratio. More dehumidification can be achieved without over cooling the space. Additionally, the pre-cool, reheat recuperation can be used to proportionately control the sensible heat ratio. By controlling how much and how often refrigerant is diverted through the recuperating units (e.g., coils), the dehumidification capacity can be controlled to a desired level.

In another aspect, recuperation is performed using units (e.g., a pair of coils) connected by a two-phase refrigerant that is provided by reducing the pressure of a refrigerant liquid from a cooling cycle leaving a condenser to a suitable saturation temperature/pressure for a heat transport function, prior to the refrigerant flowing to an expansion device and into an evaporator.

In another aspect, the invention features a method for dehumidification, including introducing a refrigerant from a heating unit to a cooling unit along a first path; introducing the refrigerant from the cooling unit to the heating unit along a second path different from the first path; introducing the refrigerant from the heating unit to the cooling unit along a third path different from the first path; and contacting the cooling unit and the heating unit with a first gas stream.

Embodiments may include one or more of the following features. The method further includes condensing a liquid from the first gas stream, the liquid condensing between the cooling unit and the heating unit along a flow path of the first gas stream. The method further includes heating the first gas stream after the first gas stream contacts the heating unit. The method further includes introducing the refrigerant from a condenser to the heating unit. The method further includes preventing introduction of the refrigerant from a condenser to the heating unit. The method further includes introducing the refrigerant from the cooling unit to an expansion device. The method further includes introducing the refrigerant from the heating unit to an expansion device without introducing the refrigerant to the cooling unit. The method further includes collecting a condensed liquid. The method further includes introducing the refrigerant from the cooling unit to the heating unit along a fourth path different from the second path. The method includes, in sequence, contacting the cooling unit with the first gas stream, condensing a liquid from the first gas stream, contacting the heating unit with the first gas stream, and heating the first gas stream. The method further includes cooling a condenser with a second gas stream different from the first gas stream. The method further includes cooling the condenser with the first gas stream. The first gas stream does not substantially cool the condenser. The method includes flowing the refrigerant between the heating unit and the cooling unit for three or more cycles.

In another aspect, the invention features a method for dehumidification, including introducing a refrigerant from a condenser to a cooling unit along a first path; introducing the refrigerant from the cooling unit to a heating unit along a second path different from the first path; and introducing the refrigerant from the heating unit to an evaporator along a third path different from the first and second paths, wherein the refrigerant includes a liquid and a vapor in at least one of the paths.

Embodiments may include one or more of the following features. The method further includes introducing the refrigerant from the cooling unit to the heating unit along a fourth path different from the second path; and introducing the refrigerant from the heating unit to the cooling unit along a fifth path different from the third path. The method further includes contacting, in sequence, the cooling unit, the evaporator, the heating unit, and the condenser with a first gas stream. The method further includes sequentially contacting the cooling unit, the evaporator, and the heating unit with a first gas stream. The method further includes cooling the condenser with a second gas stream different from the first gas stream. The method further includes cooling the condenser with the first gas stream. The first gas stream does not substantially cool the condenser. The method further includes heating the first gas stream after contacting the heating unit with the first gas stream. The refrigerant has a temperature glide between its bubble point and its dew at a given pressure. The method further includes preventing introduction of the refrigerant from the condenser to the cooling unit. The method further includes expanding the refrigerant from the condenser to the cooling unit, and pumping the refrigerant from the cooling unit to the heating unit.

In another aspect, the invention features a method for dehumidification, including cooling a first gas stream with an evaporator; cooling a condenser with a second gas stream separate from the first gas stream; and delivering the cooled first gas stream and the second gas stream after cooling the condenser to a selected environment.

Embodiments may include one or more of the following features. The method further includes, after cooling the first gas stream with the evaporator, heating the first gas stream. The first gas stream does not substantially cool the condenser. The method further includes cooling the condenser with the cooled first gas stream. The method further includes introducing a refrigerant from a heating unit to a cooling unit along a first path; introducing the refrigerant from the cooling unit to the heating unit along a second path different from the first path; and introducing the refrigerant from the heating unit to the cooling unit along a third path different from the first path. The method further includes introducing the refrigerant from the condenser to the heating unit. The method further includes introducing the refrigerant from the cooling unit to the heating unit along a fourth path different from the second path.

In another aspect, the invention features a method of dehumidification, including contacting a cooling unit, an evaporator, a heating unit, and a condenser with a first gas stream; introducing a refrigerant from the cooling unit to an expansion device and to the heating unit; and introducing the refrigerant from the heating unit to a pump and to the cooling unit.

Embodiments may include one or more of the following features. The method further includes preventing introduction of the refrigerant from the cooling unit to the expansion device. The method further includes preventing introduction of the refrigerant from the cooling unit to the pump. The refrigerant from the cooling unit includes a vapor. The refrigerant from the heating unit includes a liquid.

In another aspect, the invention features a dehumidification system, including a heating unit; a cooling unit in fluid communication with the heating unit; and a refrigerant capable of flowing from the heating unit to the cooling along a first path, flowing from the cooling unit to the heating unit along a second path different from the first path, and flowing from the heating unit to the cooling unit along a third path different from the first path.

Embodiments may include one or more of the following features. The system further includes an evaporator between the cooling unit and the heating unit along a flow path of a first gas stream. The system further includes a condenser downstream of the flow path of the first gas stream. The system further includes a condenser that is not along the flow path of the first gas stream. The condenser is configured to be cooled by a second gas stream separate from the first gas stream. The system further includes a condenser configured to be cooled by the first gas stream and a second gas stream that is not cooled by the evaporator. The system further includes a second heating unit downstream of the heating unit along a flow path of a first gas stream. The system further includes a condenser configured to introduce the refrigerant to the heating unit. The system further includes a valve capable of preventing introduction of the refrigerant from a condenser to the heating unit. The system further includes an expansion device downstream of the cooling unit along a flow path of the refrigerant. The system further includes an expansion device downstream of the heating unit, but not the cooling unit, along a flow path of the refrigerant. The refrigerant is capable of flowing from the cooling unit to the heating unit along a fourth path different from the second path. The system includes, arranged sequentially along a flow path of a first gas stream, the cooling unit, an evaporator, and the heating unit. The system further includes a condenser downstream of the heating unit along the flow path of the first gas stream.

In another aspect, the invention features a dehumidification system, including a condenser; a cooling unit in fluid communication with the condenser; a heating unit in fluid communication with the cooling unit; an evaporator in fluid communication with the heating unit; and a refrigerant capable of flowing from the condenser to the cooling unit along a first path, flowing from the cooling unit to a heating unit along a second path different from the first path, and flowing from the heating unit to the evaporator along a third path different from the first and second paths, wherein the refrigerant includes a liquid and a gas in at least one of the paths.

Embodiments may include one or more of the following features. The refrigerant is capable of flowing from the cooling unit to the heating unit along a fourth path different from the second path, and flowing from the heating unit to the cooling along a fifth path different from the third path. The cooling unit, the evaporator, the heating unit, and the condenser are arranged sequentially along a path of a first gas stream. The cooling unit, the evaporator, and the heating unit are arranged sequentially along a path of a first gas stream. The system further includes a second heating unit downstream of the heating unit along a path of a first gas stream. The system further includes a condenser that is not along the flow path of the first gas stream. The condenser is configured to be cooled by a second gas stream separate from the first gas stream. The system further includes a condenser configured to be cooled by the first gas stream and a second gas stream that is not cooled by the evaporator. The refrigerant has a temperature glide between its bubble point and its dew at a given pressure. The system further includes a valve capable of preventing introduction of the refrigerant from the condenser to the cooling unit.

In another aspect, the invention features a dehumidification system, including a cooling unit; a heating unit in fluid communication with the cooling unit; an evaporator downstream of the cooling unit along a flow path of a gas stream; a condenser downstream of the heating unit along the flow path of the gas stream; and a refrigerant flow path extending from the cooling unit, to an expansion device, to the heating unit, to a pump, and to the cooling unit.

Embodiments may include one or more of the following features. The system further includes a shutoff valve along the refrigerant flow path between the cooling unit and the expansion device. The system further includes a one-way check valve along the refrigerant flow path between the pump and the cooling unit. The expansion device is capable of providing power to the pump.

Embodiments may further include one or more of following advantages.

The methods and systems described herein can provide greater control over dehumidification and increased efficiency at low cost, which can provide a competitive advantage and make effective dehumidification available to a broader group.

The methods and systems described herein can be implemented in a relatively uncomplicated and inexpensive manner to enhance dehumidification, e.g., in air conditioning systems. For example, implementation can be relatively compact, and can result in a relatively inexpensive overall system because there is less deviation, for example, from standard air conditioner manufacturing techniques. Implementation can be achieved without a completely separate fluid system having a series of valves and a circulating pump, without a number of solenoid valves that adapt to operating conditions (such as for hot dry conditions that may require cool system supply temperature but not much dehumidification), and/or without dampers and heat exchanger bypass.

Embodiments described herein are fully scalable. The overall sizes of the recuperating units and proportional sizes of the various coils can be adjusted between a wide range of values and applied to a wide range of dehumidifier or air conditioner sizes/capacities.

The methods and systems described herein can provide collection of the water that is removed from the air. The collected water, for example, can be treated (e.g., for drinking), stored for dispensing when needed, and/or heated or cooled.

Still other aspects, features and advantages will be apparent from the description of the embodiments thereof and from the claims.

DETAILED DESCRIPTION

Figure 1A:
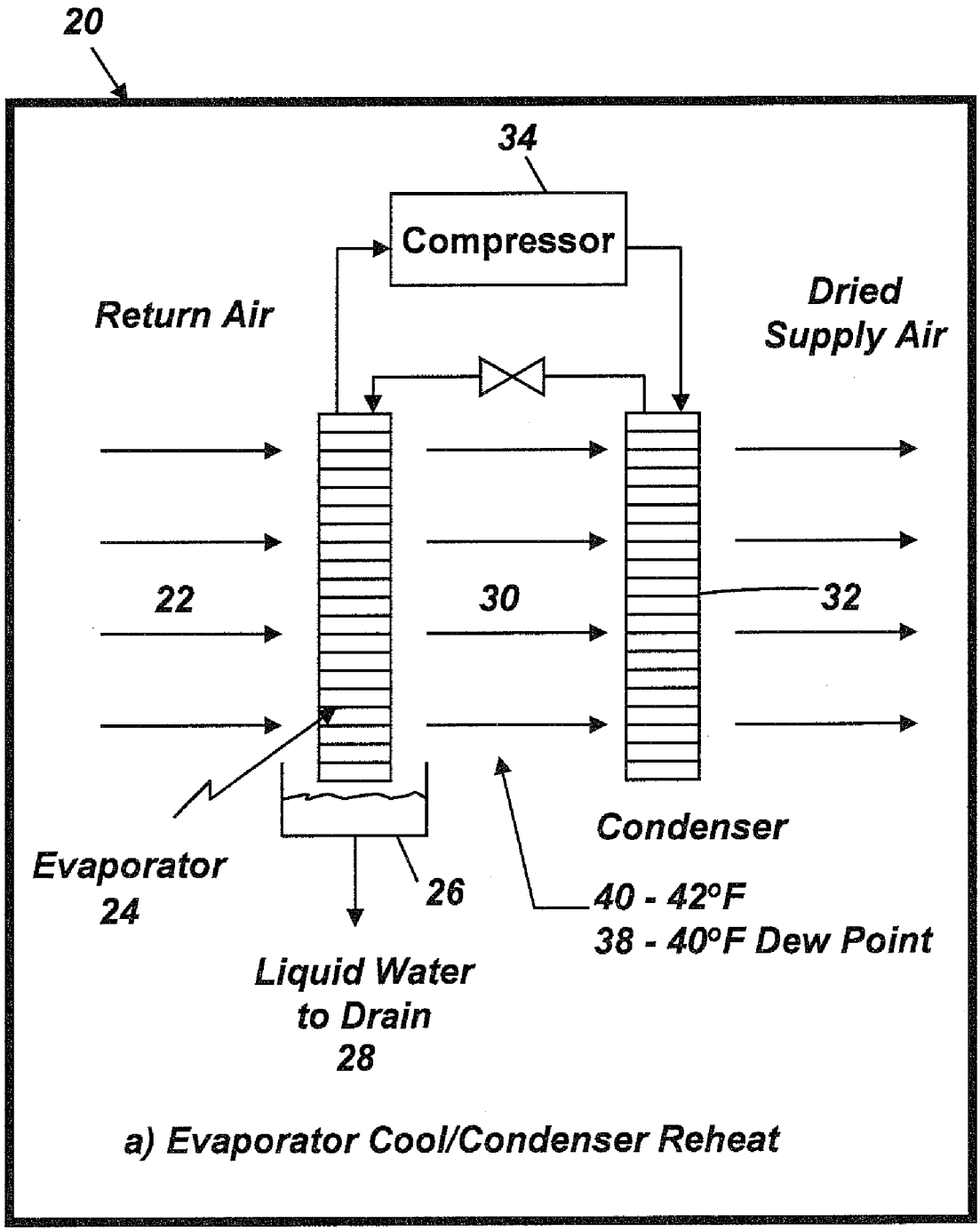
FIG. 1A (Prior Art)
FIG. 1A is a schematic diagram of an embodiment of a dehumidification system.
Figure 1B:
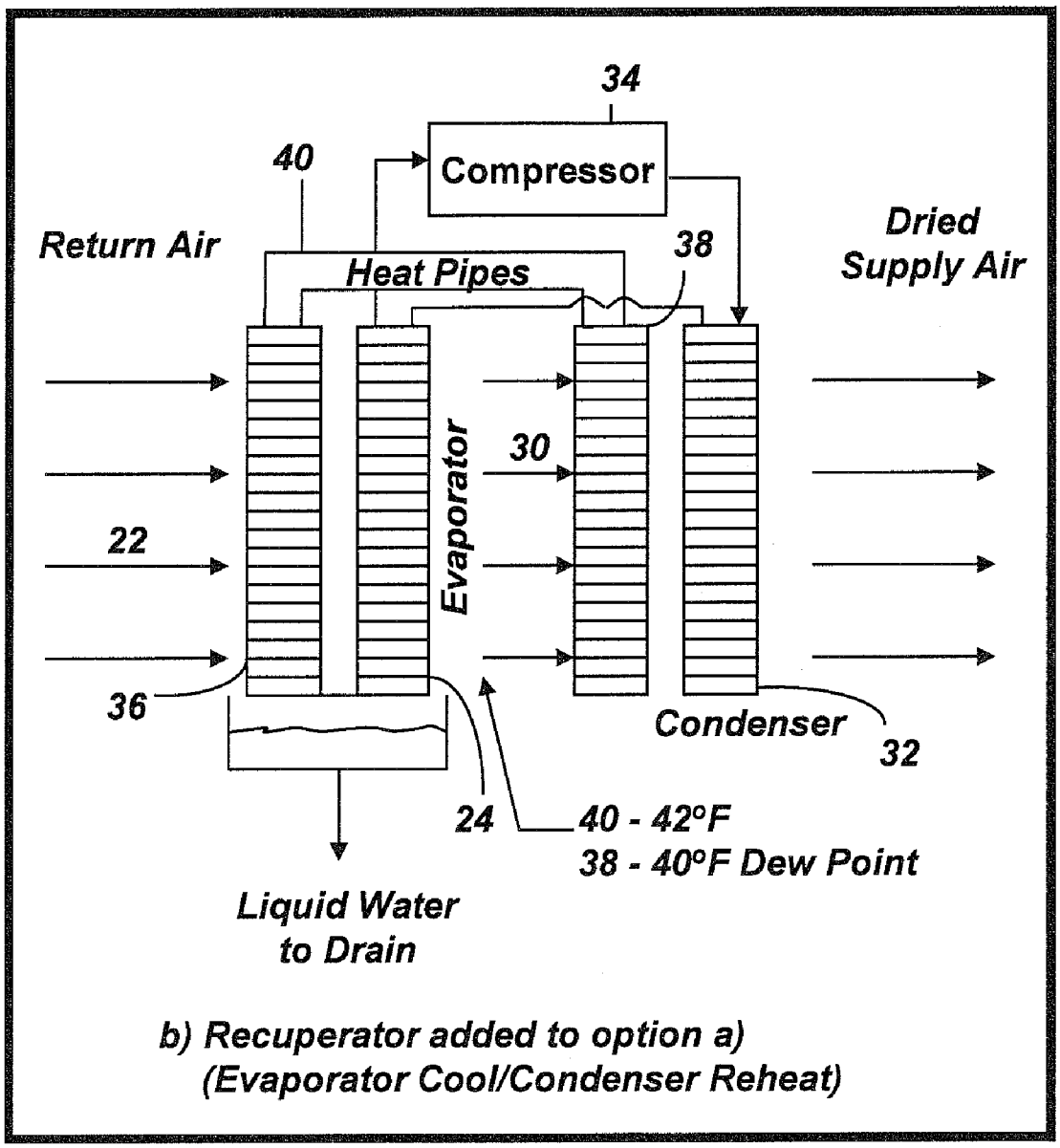
FIG. 1B (Prior Art)
FIG. 1B is a schematic diagram of an embodiment of a recuperated dehumidification system.
Figure 2:
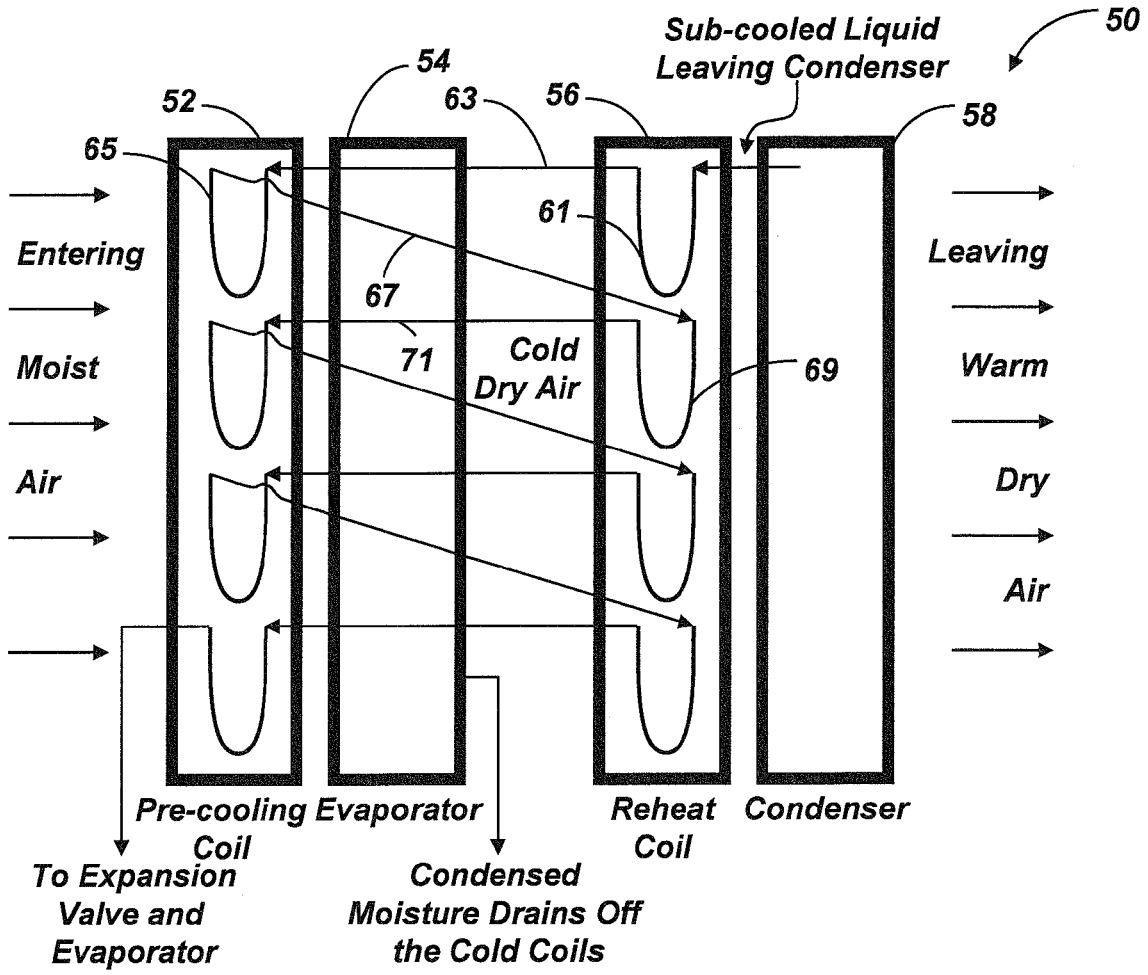
FIG. 2 is a schematic diagram of an embodiment of a dehumidification system in which a refrigerant transports heat from a pre-cooling coil to a reheating coil.

FIG. 2 shows an embodiment of a dehumidification system 50 in which all thermal functions are packaged in a single unit so that heat rejected from a cooling cycle is added to a dehumidified air stream. Dehumidification system 50 includes a pre-cooling unit (as shown, a coil 52), an evaporator 54, a reheating unit (as shown, coil 56), and a condenser 58 arranged sequentially along a path of a gas stream (e.g., moist air, inert gases such as nitrogen or argon, hydrogen). (For clarity, a compressor is not shown.) Recuperative cooling is provided by pre-cooling coil 52 and reheating coil 56 that are connected by alternating passes of a refrigerant liquid from the cooling cycle. As shown, the air stream to be dehumidified passes through a series of four coils: first, the air passes through pre-cooling coil 52 where heat is transferred from the air to the refrigerant liquid; next, the cooled air passes through refrigerant evaporator 54 where the air is sufficiently cooled to condense moisture; next, the cool dried air passes through reheating coil 56 where heat is transferred from the refrigerant liquid to the air; and finally through condenser 58 to provide warm dry air.

As shown, heat that is removed from the air stream by pre-cooling coil 52 is transported to reheating coil 56 by the liquid refrigerant. The refrigerant originates as sub-cooled liquid from condenser 58 and shuttles back and forth between pre-cooling and reheating coils 52, 56 several times along multiple serially connected paths, first removing heat from the entering air, then adding heat to the leaving air, repeating this process several times and eventually exiting the pre-cooling coil to an expansion device (e.g., a thermostatic expansion valve, a short orifice, or a capillary tube) and evaporator 54. More specifically, the refrigerant flows through a first portion 61 of reheating coil 56, then flows to pre-cooling coil 52 along a first path 63, then flows through a first portion 65 of the pre-cooling coil, then flows back to the reheating coil along a second path 67 that is different from the first path, then flows through a second portion 69 of the reheating coil different from first portion 61, and then flows to the pre-cooling coil along a third path 71 that is different from the first and second paths. As shown, in FIG. 2, this cycle of flow is repeated along different portions of reheating and pre-cooling coils 56, 52 and along different paths until the refrigerant eventually exits the pre-cooling coil to the expansion device and evaporator 54 (as shown, after four complete cycles). Shuttling the liquid back and forth multiple times (e.g., three, four, five, six, seven, eight or more complete cycles) is performed because the heat capacity of the liquid refrigerant flow can be several times less than the heat capacity of the air flow. The number of cycles can be selected by optimizing the match between the mass flow of the refrigerant and the mass flow of the gas stream flow. In some embodiments, this recuperation increases the coil size by approximately 33%, but the refrigerant connections are conventional and can be made at the same time that the rest of the coil assembly return bend and refrigerant line brazed connections are made. This recuperation can provide the same function, for example, as individual heat pipes connecting pre-cooling and reheating coils, but more simply. In some embodiments, for example, in systems without a condenser, additional reheating can be provided by adding a reheating unit (such as a hot gas reheating coil or a reheating coil driven by another heat source (e.g., electric heat, hot water, steam, and/or fuel firing)).

Figure 3:
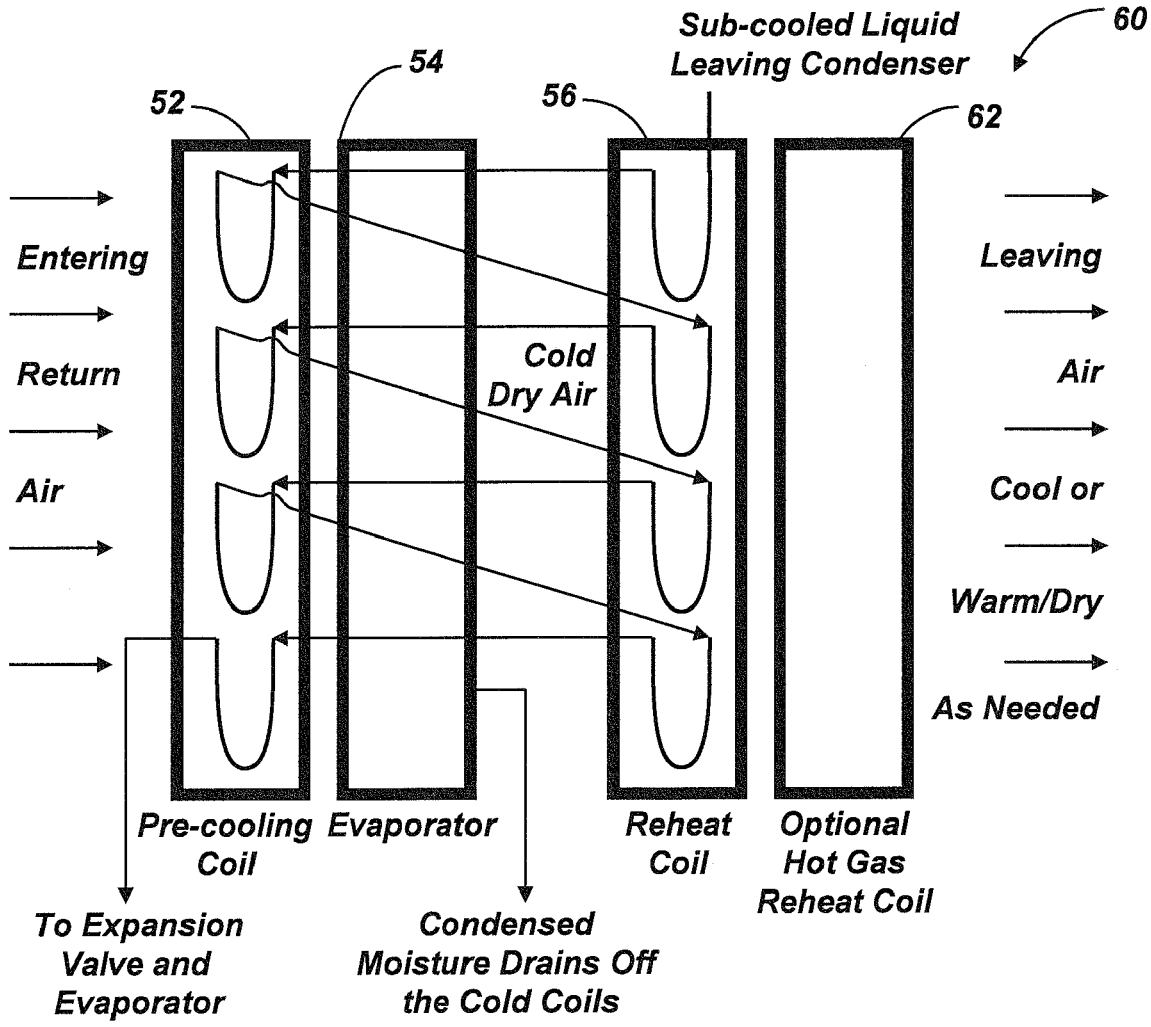
FIG. 3 is a schematic diagram of an embodiment of an air conditioning system in which a refrigerant transports heat from a pre-cooling coil to a reheating coil.

The recuperation process described above can be applied to any device in which a liquid flow is used to cool a gas to achieve enhanced dehumidification without a significant reduction in heating capacity. For example, a dehumidifying heat pump water heater dehumidifies the air around it as it heats water, so recuperating units (e.g., coils) can be added to an evaporator of the heat pump water heater to achieve greater dehumidification. As another example, referring to FIG. 3, the recuperation process can be applied in an air conditioning system to provide enhanced dehumidification when needed. As shown, air conditioning system 60 is similar to dehumidification system 50, except that the gas stream does not pass through a condenser and system 60 includes an optional reheating unit (as shown, a hot gas reheating coil 62) to provide warmer dehumidified air when wanted. Condenser 58, which is located at an appropriate location to reject heat from system 60, is cooled by other means, such as a separate outdoor air stream or with cooled water.

Figure 4:
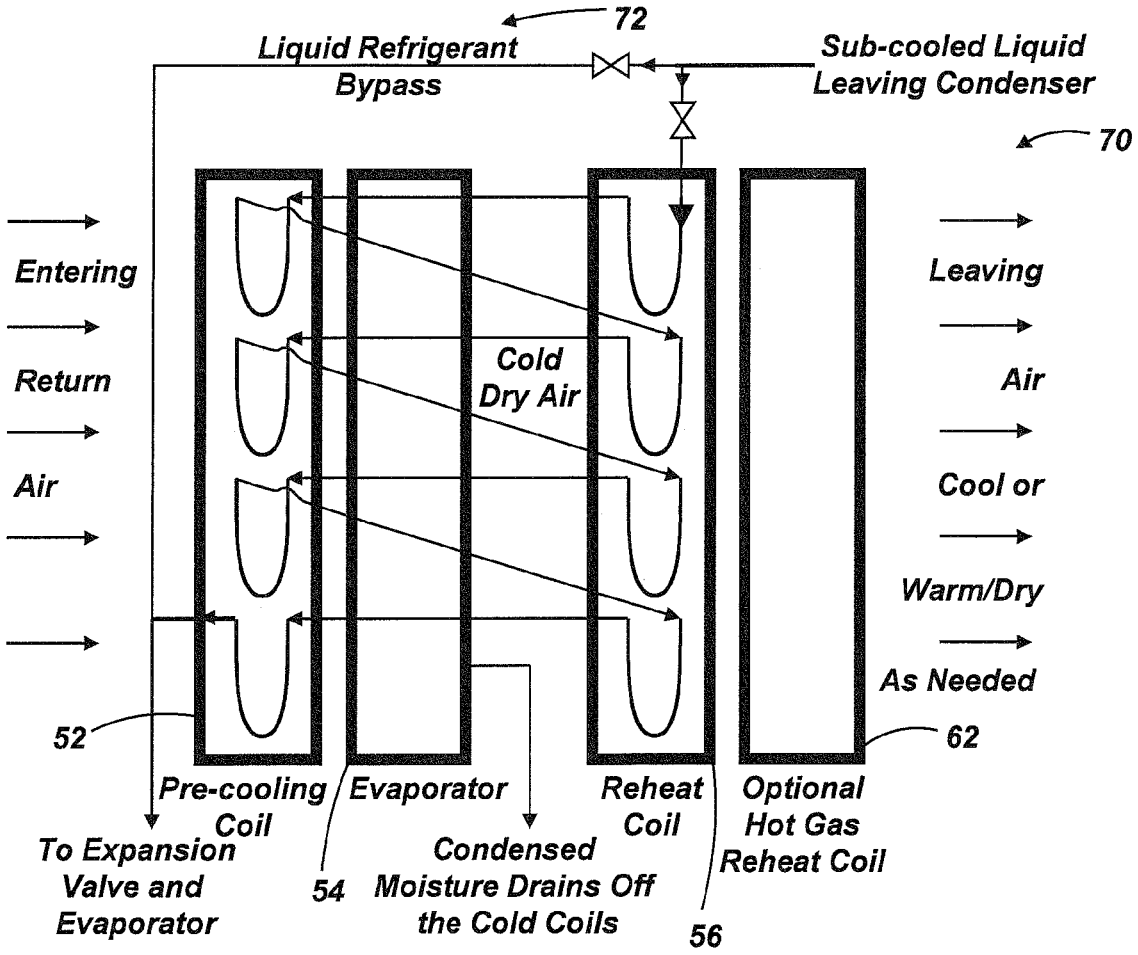
FIG. 4 is a schematic diagram of an embodiment of an air conditioning system in which a refrigerant transports heat from a pre-cooling coil to a reheating coil and further including a bypass of a recuperating system.

In some embodiments, referring to FIG. 4, dehumidification (as shown, control of a dehumidification system 70) is enhanced by providing a selective bypass 72 of the liquid refrigerant flow around pre-cooling and reheating units (e.g., coils 52, 56) and to an expansion device and evaporator. For example, when dehumidification beyond that provided by normal air conditioner operation is not wanted, coils 52, 56 are bypassed and are left inactive. When additional dehumidification is wanted, bypass 72 allows the liquid refrigerant to selectively flow through pre-cooling and reheating coils 52, 56, with the net effect that the dehumidification capacity is increased, while the sensible cooling capacity is decreased. As shown, embodiments can include an optional reheating unit (such as a hot gas reheating coil), depending on how wide a range of dehumidification enhancement or sensible heat ratio is wanted.

Figure 5:
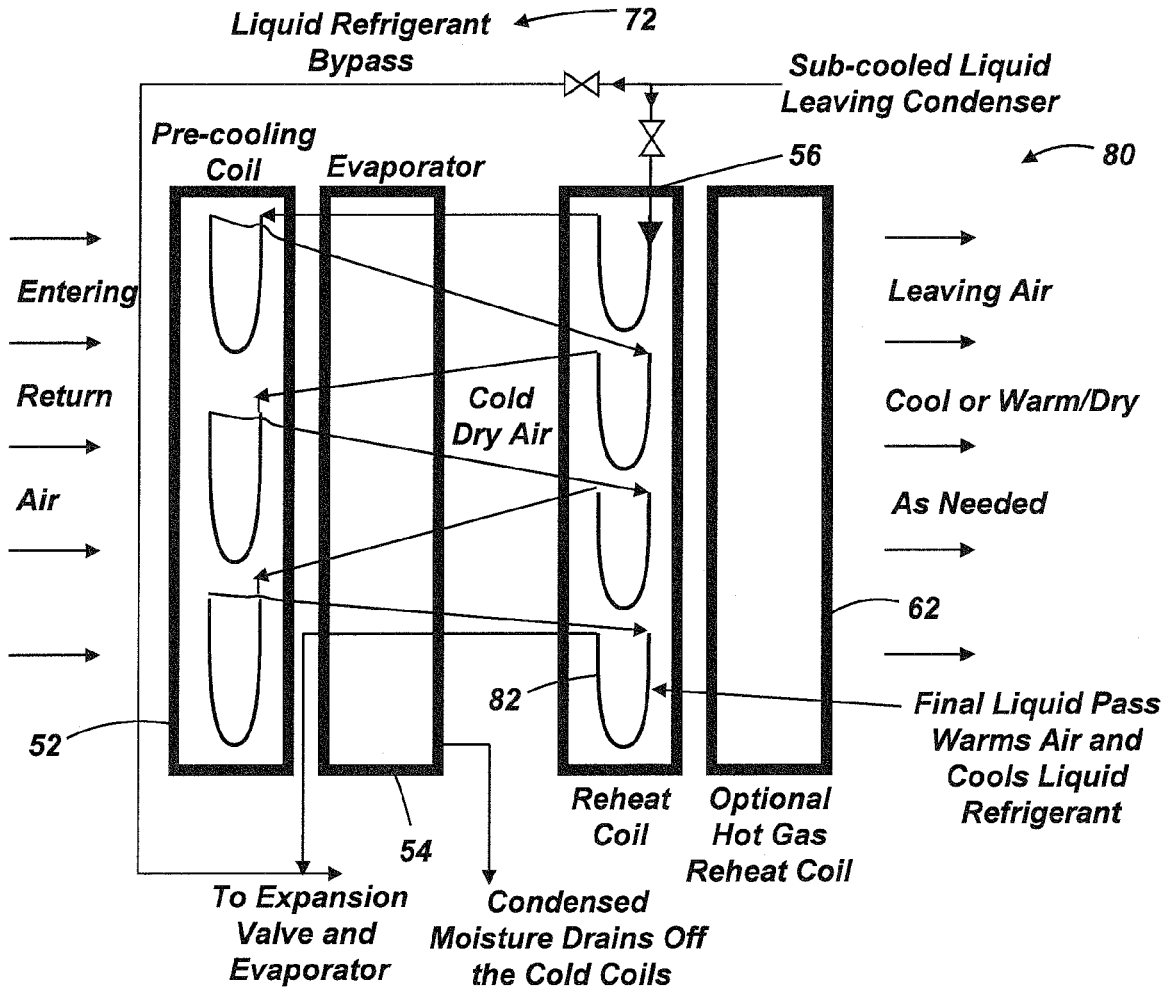
FIG. 5 is a schematic diagram of an embodiment of an air conditioning system in which a final pass of refrigerant occurs in a reheat coil, so the refrigerant enters an expansion device with a lower temperature.

In some embodiments, a final pass of the liquid refrigerant in a reheating unit is cooled by the air leaving the evaporator before the refrigerant enters an expansion device. FIG. 5 shows a dehumidification system 80 in which a final pass 82 of the liquid refrigerant in a reheating unit (as shown, coil 56) is cooled by the gas stream leaving a cooling unit (as shown, evaporator 54), thereby providing additional reheat of the gas stream and reducing the temperature of the refrigerant. As a result, the refrigerant is further sub-cooled prior to expansion, the evaporator capacity is further increased (e.g., maximized) due to further reduction in refrigerant enthalpy, and moisture removal is further increased.

Figure 6A:
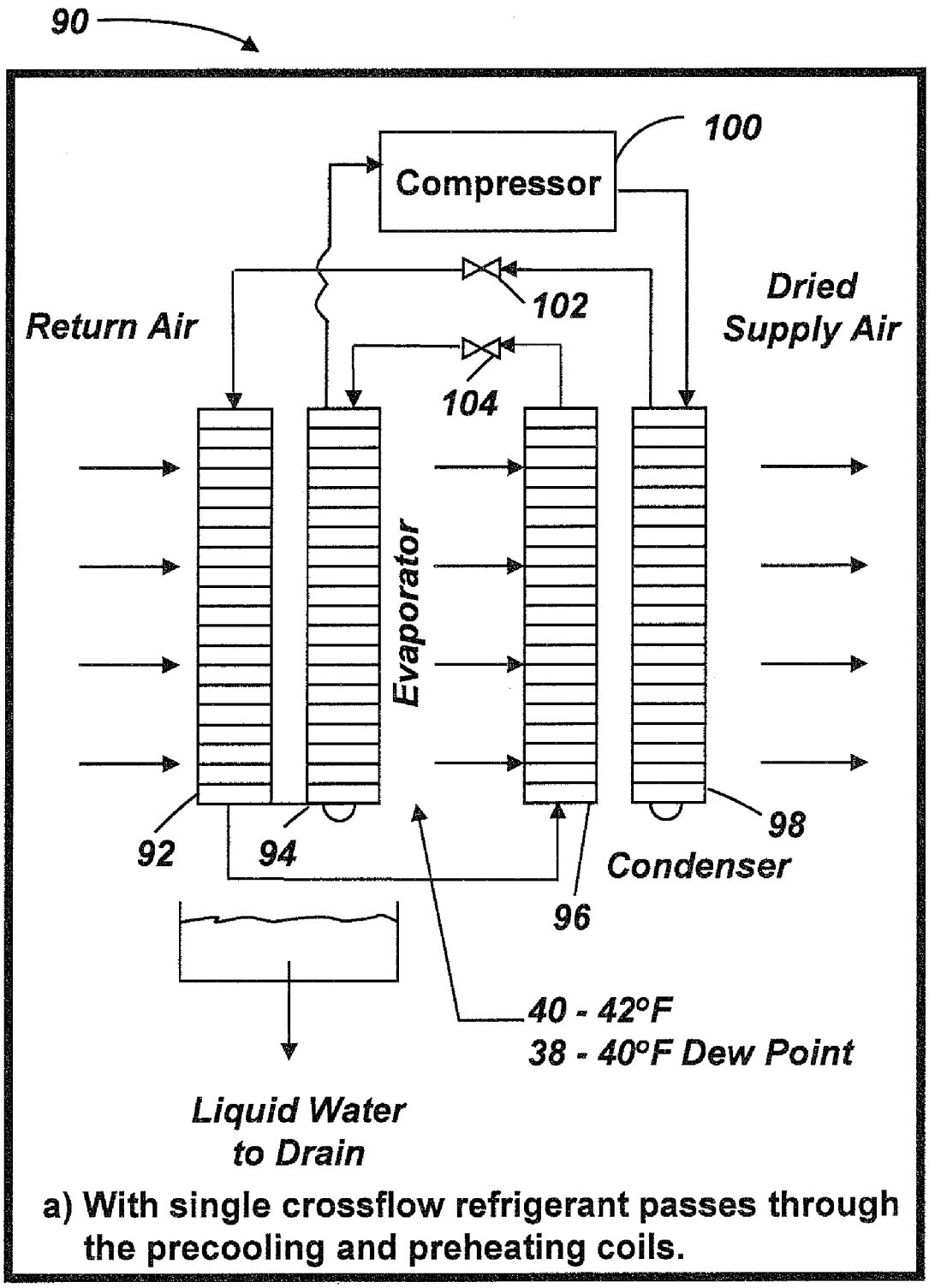
FIG. 6A is a schematic diagram of an embodiment of a dehumidification system in which a refrigerant exiting a condenser is reduced in pressure and passes through a pre-cooling coil, where it absorbs heat from incoming air by evaporating.

While the refrigerant is described above as being a liquid, in other embodiments, the heat transport function is provided by a two-phase refrigerant flow from a cooling cycle. FIG. 6A shows a dehumidification system 90 in which the gas (e.g., air) to be dehumidified passes through a series of four units: the gas first passes through a pre-cooling unit (e.g., a pre-cooling coil 92); then the gas passes through an evaporator 94 (where the gas is cooled sufficiently to condense moisture); next, the cool dried gas passes through a reheating unit (e.g., a reheating coil 96); and then the gas passes through a condenser 98. As shown, pre-cooling coil 92 is in fluid communication with reheating coil 96 and condenser 98, which is also in fluid communication with evaporator 94 via a compressor 100. Evaporator 94 is also in fluid communication with reheating coil 96. Heat that is removed from the gas stream by pre-cooling coil 92 causes a portion of the reduced-pressure liquid refrigerant to evaporate as the gas passes through the pre-cooling coil. When this two-phase (liquid and vapor) refrigerant then passes through reheating coil 96, the vapor condenses and supplies heat to reheat the gas. Liquid refrigerant leaving condenser 98 is reduced in pressure (as shown, using a pressure reducing or expansion device 102) to an appropriate saturation temperature and then passes through pre-cooling coil 92 and reheating coil 96. After leaving reheating coil 96, the reduced-pressure liquid refrigerant then flows to an expansion device 104 and evaporator 94, as in a conventional cooling cycle. As shown in FIG. 6A, the reduced-pressure liquid refrigerant makes a single pass though each of pre-cooling and reheating coils 92, 96, at one saturation temperature/pressure.

Figure 6B:
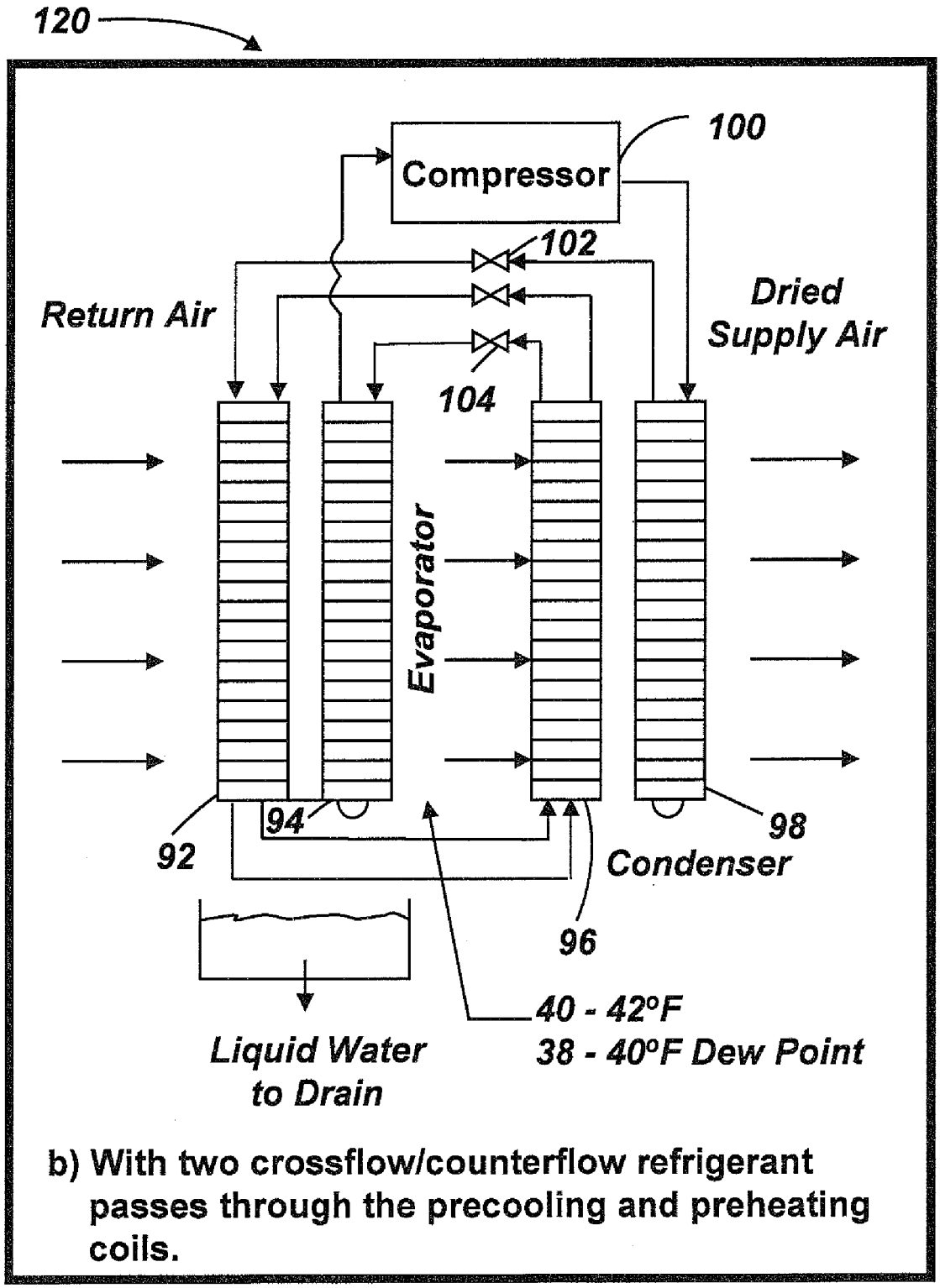
FIG. 6B is a schematic diagram of an embodiment of a dehumidification system in which the process shown in FIG. 6A is repeated through pre-cooling and re-heat coils at least a second time to provide crossflow-counterflow heat transfer and to increase the amount of recuperative pre-cooling and reheating.

In other embodiments, referring to FIG. 6B, system 120 includes a liquid refrigerant that makes two or more passes (as shown, two) at two different saturation temperature/pressure levels, providing for counter-flow heat transfer in both pre-cooling and reheating coils 92, 96, and allowing a higher level of recuperative pre-cooling and reheating. Optionally, additional reheating can be provided by adding a hot gas reheating coil or reheating can be provided by another heat source (e.g., electric heat, hot water, steam, or fuel firing). Similar to the other embodiments described herein, all thermal functions of the embodiments shown in FIGS. 6A and 6B can be packaged in a single unit, so that the heat rejected from the cooling cycle is added to the dehumidified gas stream. Furthermore, the embodiments shown in FIGS. 6A and 6B can include shuttling of a refrigerant between pre-cooling and reheating units 92, 96 as described herein.

Counter-flow heat transfer in pre-cooling and reheating coils 92, 96 can also be achieved through the use of a refrigerant or a refrigerant blend that has a temperature glide between its bubble point and its dew point at a given pressure. Depending on the selection of refrigerant composition, compressor capacity, and air flow rate, the glide in temperature of the two-phase refrigerant in this case can match or substantially match the temperature drop (in pre-cooling coil 92) or rise (in reheating coil 96), thus allowing for increased (e.g., maximum) heat exchanging performance with one refrigerant pass each for the pre-cooling and reheating coils.

Figure 7:
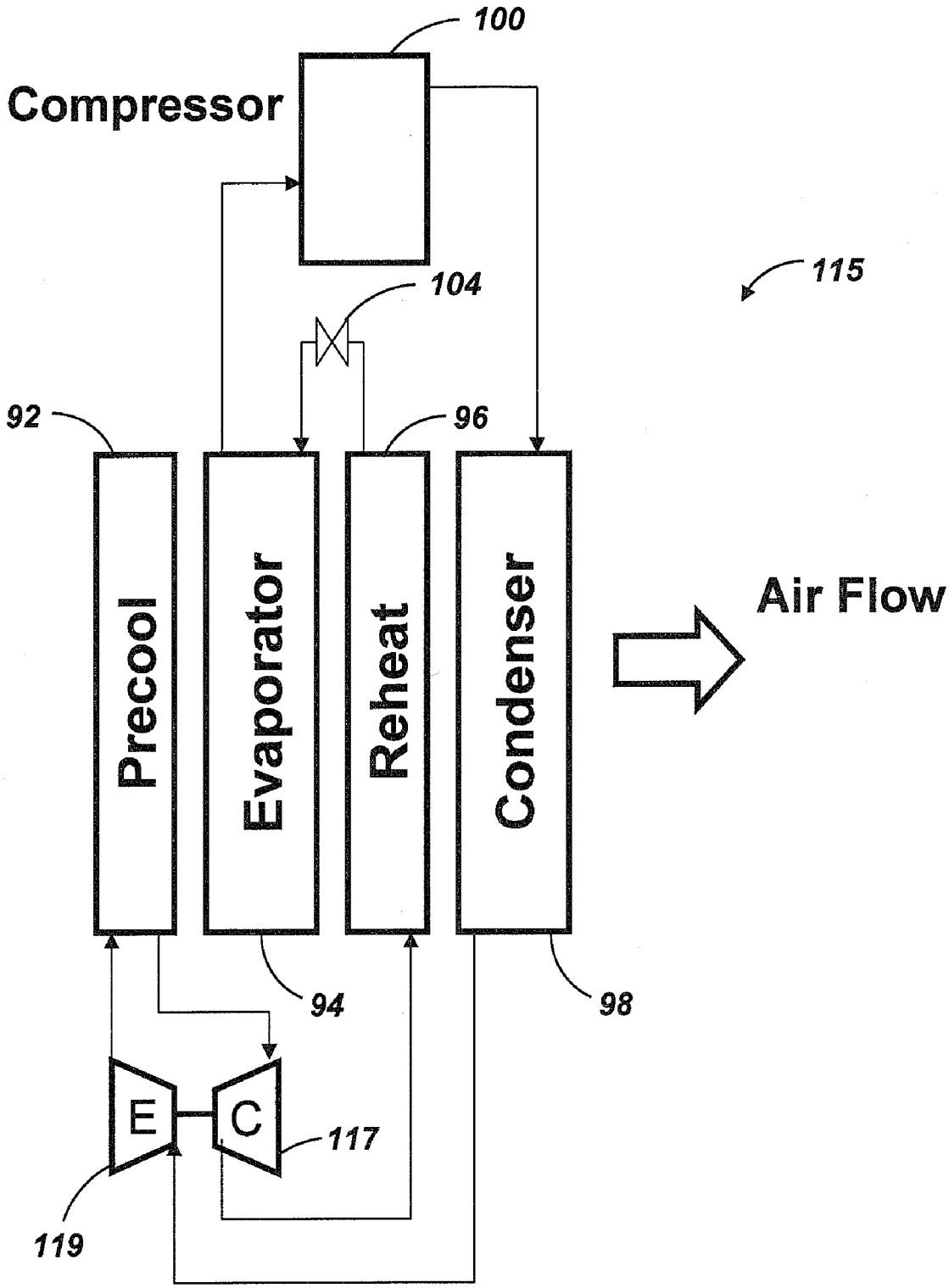
FIG. 7 is a schematic diagram of an embodiment of a dehumidification system in which there is a pressure lift from a pre-cooling unit to a reheating unit.

In some embodiments, the pressure level of the refrigerant in reheating coil 96 is higher than the pressure level in pre-cooling coil 92 in order to increase the temperature difference that drives heat transfer between the refrigerant and the air in these two recuperating coils. FIG. 7 shows a dehumidification system 115 in which the pressure lift from pre-cooling coil 92 to reheat coil 96 can be provided by a compressor 117 that is powered by a work-recovery expander 119 powered by refrigerant exiting from condenser 98 and flowing to an inlet of the pre-cooling coil.

Figure 8:
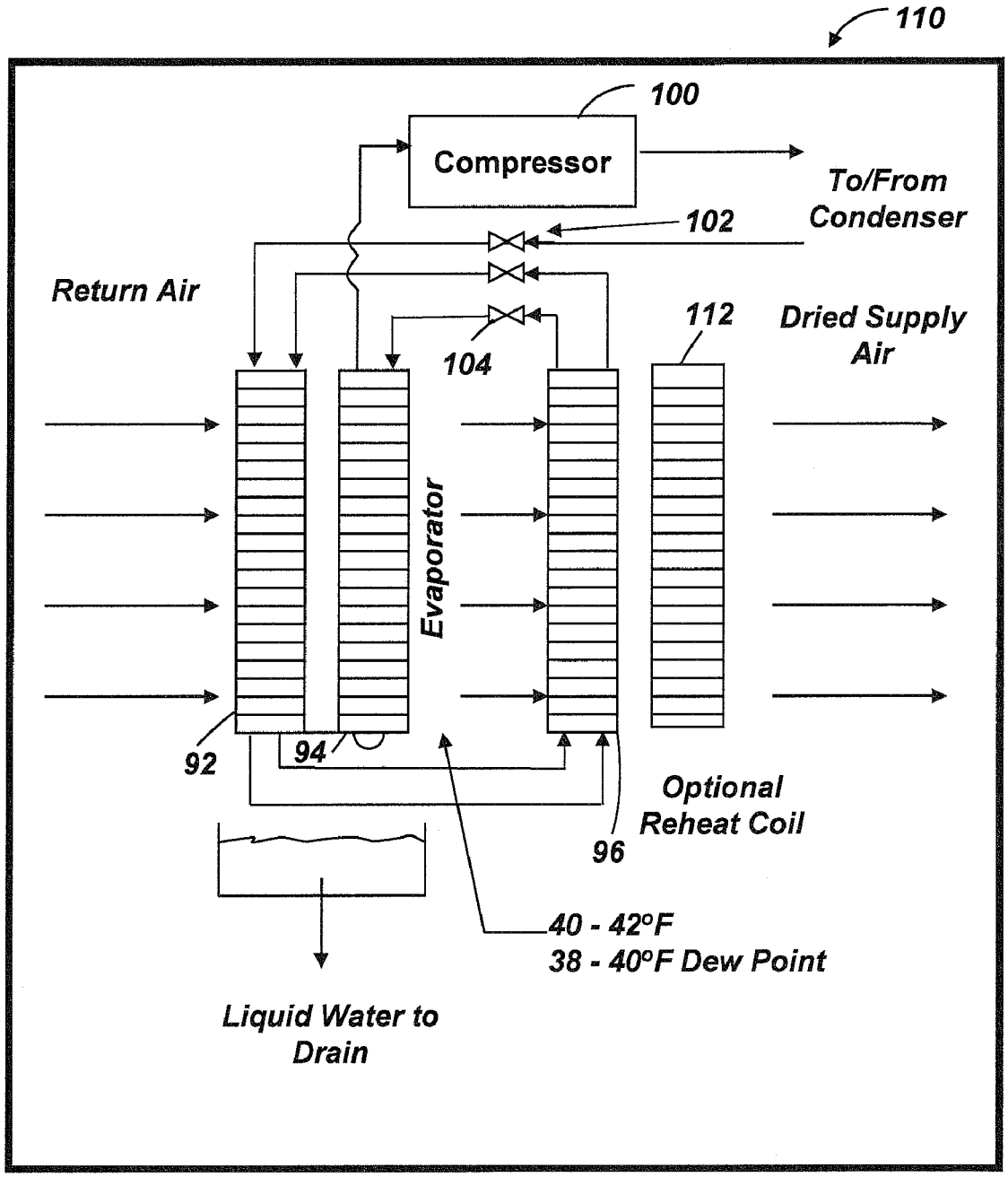
FIG. 8 is a schematic diagram of an embodiment of an air conditioning system in which a two-phase refrigerant transports heat from a pre-cooling coil to a reheating coil.

Similar to other embodiments described herein, using a two-phase refrigerant flow from a cooling cycle to provide a heat transport function can also be applied to an air conditioning system to provide enhanced dehumidification capacity, as exemplified by system 110 shown in FIG. 8. As shown, system 110 is similar to system 120 of FIG. 6B, but includes a remote condenser (not shown) and an optional reheating coil 11 2. As with other embodiments described herein (e.g., FIG. 4), the flow of refrigerant can be diverted past the pre-cooling and reheating coils by appropriate flow control valves, providing a way to apply or remove operation of this recuperative dehumidification enhancement feature. When additional dehumidification is wanted, the refrigerant can flow though a pressure-reducing valve and through one or more passes of the pre-cooling and reheating coils, with the net effect that the dehumidification capacity is increased, while the sensible cooling capacity is decreased. This system can be used with optional reheating coil 112, depending on the range of dehumidification enhancement and sensible heat ratio wanted.

Indeed, the methods described herein including a two-phase refrigerant can be applied to any device in which a refrigerant flow is used to cool air and achieve dehumidification, such as a dehumidifying heat pump water heater that dehumidifies the air around it as it heats water. As in an air conditioner or a dedicated dehumidifier, recuperating coils can be added to the evaporator of the heat pump water heater to achieve enhanced dehumidification without a significant reduction in heating capacity.

As another example, the methods described herein can be applied to a thermodynamically equivalent system in which a separate closed loop or circuit of refrigerant is circulated through the one or more passes through pre-cooling and reheating coils located in the gas stream before and after the evaporator. The refrigerant used in this loop can be the same refrigerant as the main system refrigerant or a different refrigerant that matches better to the heat transfer requirements of the pre-cooling and reheating coils.

Figure 9:
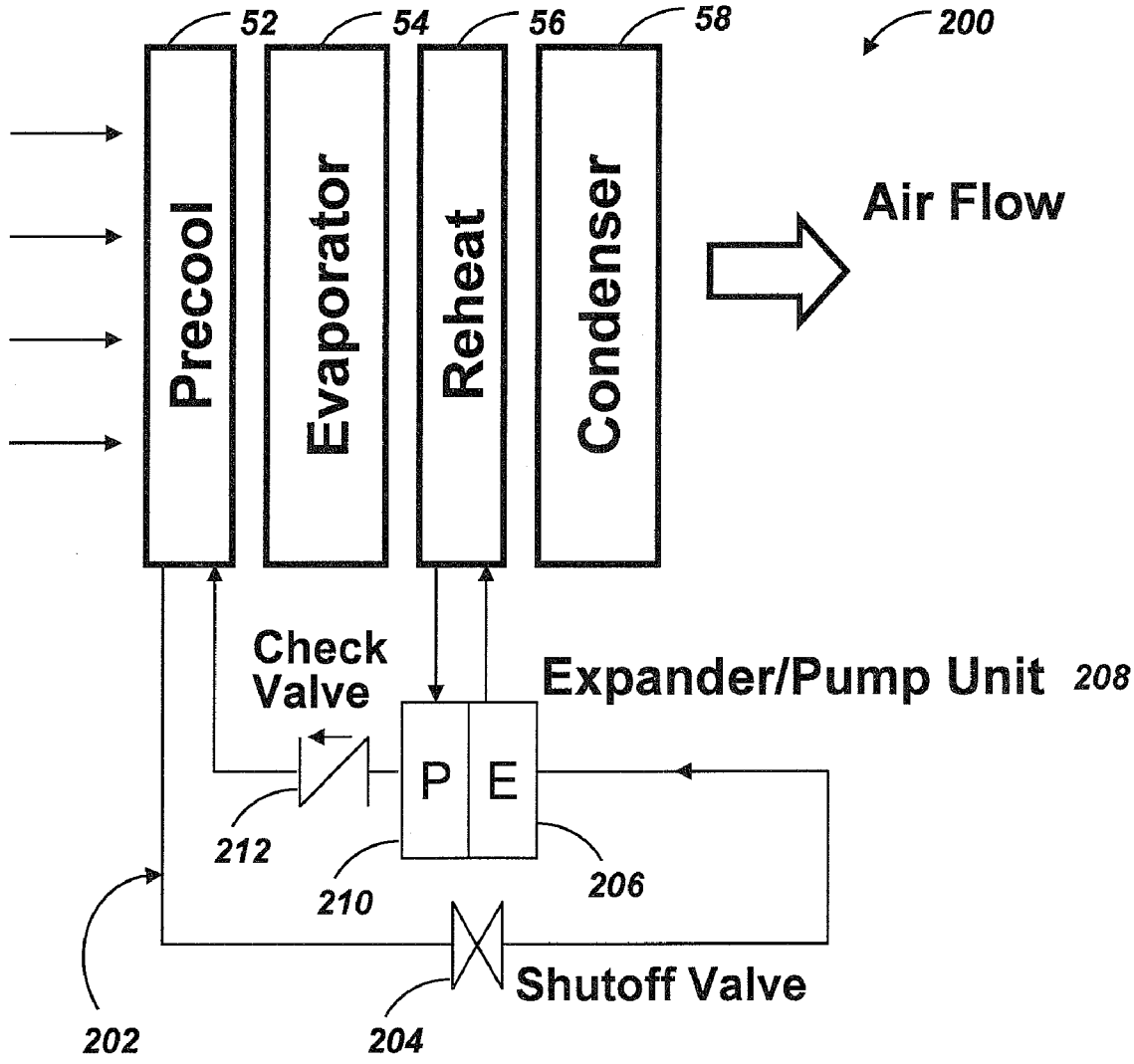
FIG. 9 is a schematic diagram of a dehumidification system including a separate refrigerant circuit using a refrigerant with temperature glide.

A separate refrigerant circuit using a refrigerant with temperature glide (i.e., the temperature of the refrigerant rises as it evaporates) can also enhance dehumidification when used in combination with an expander/pump device to move the refrigerant passively. FIG. 9 shows a recuperated dehumidification system 200 including pre-cooling unit 52, evaporator 54, reheating unit 56, and condenser 58 as generally described herein. System 200 further includes a refrigerant circuit 202 in which a refrigerant with temperature glide flows from pre-cooling unit 52, through a shutoff valve 204, to an expander 206 of an expander/pump device 208 (which is used to move the refrigerant through the circuit), through reheat unit 56, to a pump 210 of the expander/pump device, through a one-way check valve 212, and back to the pre-cooling unit. Generally, the pressure of the refrigerant in pre-cooling unit 52 is slightly higher than that in reheating unit 56. Vapor refrigerant leaving pre-cooling unit 52 is expanded to provide power to pump liquid refrigerant leaving reheating unit 56 up to a pressure sufficient to overcome a system pressure drop and to provide sufficient pressure for the expansion process.

In operation, when shutoff valve 204 is open and circuit 202 is active, liquid refrigerant is pumped into pre-cooling unit 52, where it evaporates, thus pre-cooling the air approaching evaporator 54. After leaving pre-cooling unit 52, the refrigerant mixture, which now has a high vapor quality, passes through expander 206, thus providing shaft power for pump 210. The lower-pressure refrigerant then moves on to reheating unit 56, where it condenses. After leaving reheating unit 56, the refrigerant passes to pump 210 via an inlet (not shown), and then flows back to pre-cooling unit 52. The refrigerant glide allows system 200 to be configured with both pre-cooling and reheating units 52, 56 operating in counter-flow such that the refrigerant temperature rise or drop matches that of the air passing through the system. As a result, the amount of "cooling" which can be transferred from the leaving air to the entering air can be increased (e.g., maximized).

When the operation of circuit 202 is not needed, for example, to increase sensible cooling of a cooling coil and/or when the dehumidification enhancement provided by recuperation is no longer needed, shutoff valve 204, which is downstream of pre-cooling unit 52, is used to stop flow of refrigerant through the circuit. Shutoff valve 204 prevents refrigerant from leaving pre-cooling unit 52, which causes the refrigerant pressure in the pre-cooling unit to rise. At the same time, check valve 212 blocks backflow of the refrigerant through pump 210. The pressure on the pre-cooling side of system 200 will be elevated as compared with the pressure on the reheating side due to the warmer air temperatures on the pre-cooling side of evaporator 54. Hence, when shutoff valve 204 is opened to restart recuperation, there is adequate pressure available to start flow of refrigerant through circuit 202.

While a number of embodiments have been described, the invention is not so limited.

For example, the methods described herein can be applied to a thermodynamically equivalent, cold water cooling system. In a cold water cooling system, water is used as a secondary refrigerant to carry heat from a conditioned space to a remotely located evaporator. In embodiments including a cold water distribution system, the recuperative pre-cool and reheat coils can be located in the gas stream before and after a cold water coil and the system water can be used as a heat transfer fluid.

Figure 10:
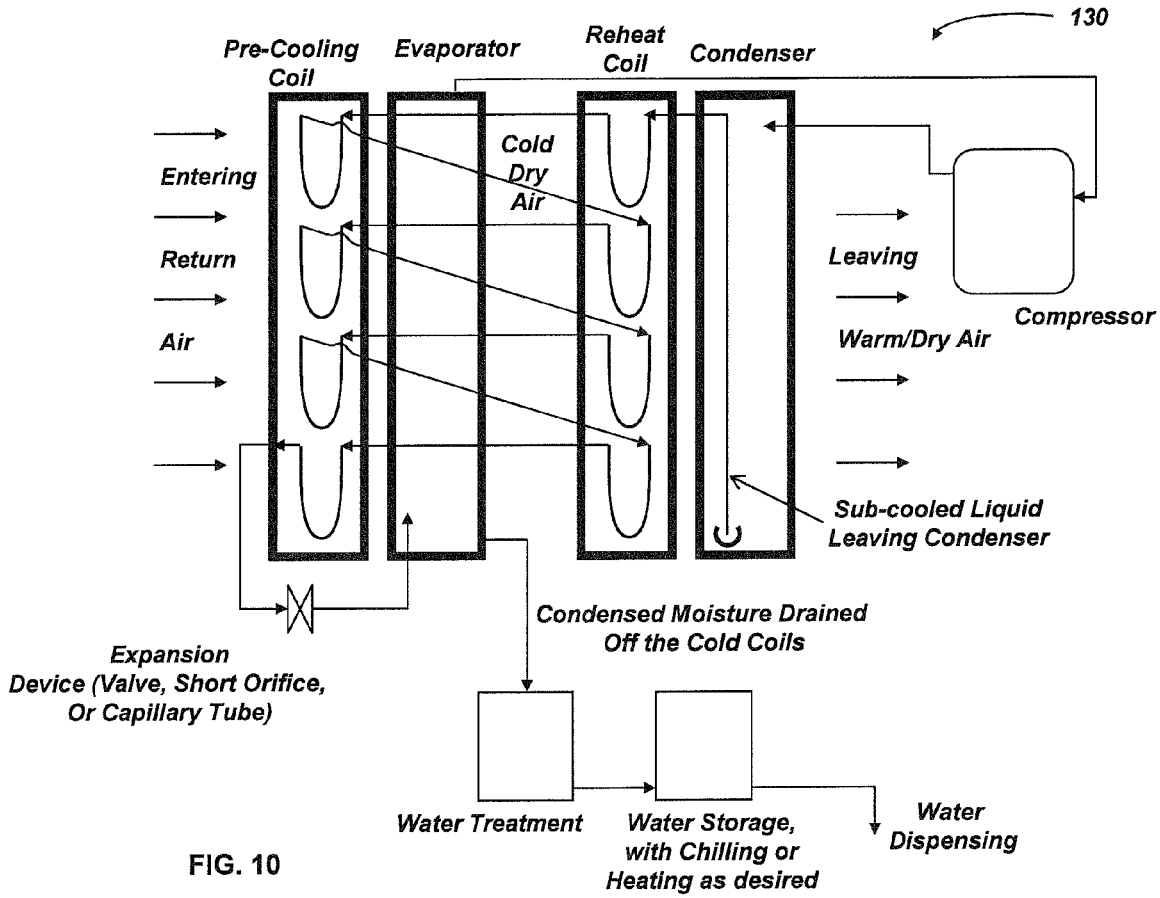
FIG. 10 is a schematic diagram of an embodiment of a dehumidification system including water collection.

As another example, referring to FIG. 10, the dehumidification systems and methods described herein can include collection of water, for example, for drinking, irrigation or other purposes, as exemplified by system 130. The liquid water condensed and collected from an evaporator and/or pre-cooling unit can be treated (if necessary) and stored for use rather than drained. For example, the collected water can be irradiated with ultraviolet radiation, filtered (e.g., charcoal filtered), treated with ozone, and/or imbued with flavor enhancers and/or nutrients (e.g., vitamins and minerals). Alternatively or additionally, the collected water can be heated and/or cooled prior to use.

While certain embodiments shown herein use the air exiting an evaporator to cool a condenser, in other embodiments, the condenser is cooled with another gas stream (e.g., ambient air), or a combination of air exiting an evaporator and another gas stream. Without being bound by theory, it is believed that in many dehumidification systems, the heat input into a gas stream at a condenser is greater than the heat removed from the gas stream in the evaporator. Furthermore, because some of the cooling performed in the evaporator is used to condense water vapor, the temperature rise of the gas stream in the condenser is considerably higher than the temperature reduction of the gas stream in the evaporator. As a result, a portion of the condenser operates with cooling air that can be considerably higher than ambient temperature. But by using separate gas streams for the evaporator and the condenser, the performance of the condenser and/or the dehumidification system can be enhanced (e.g., optimized).

Figure 11:
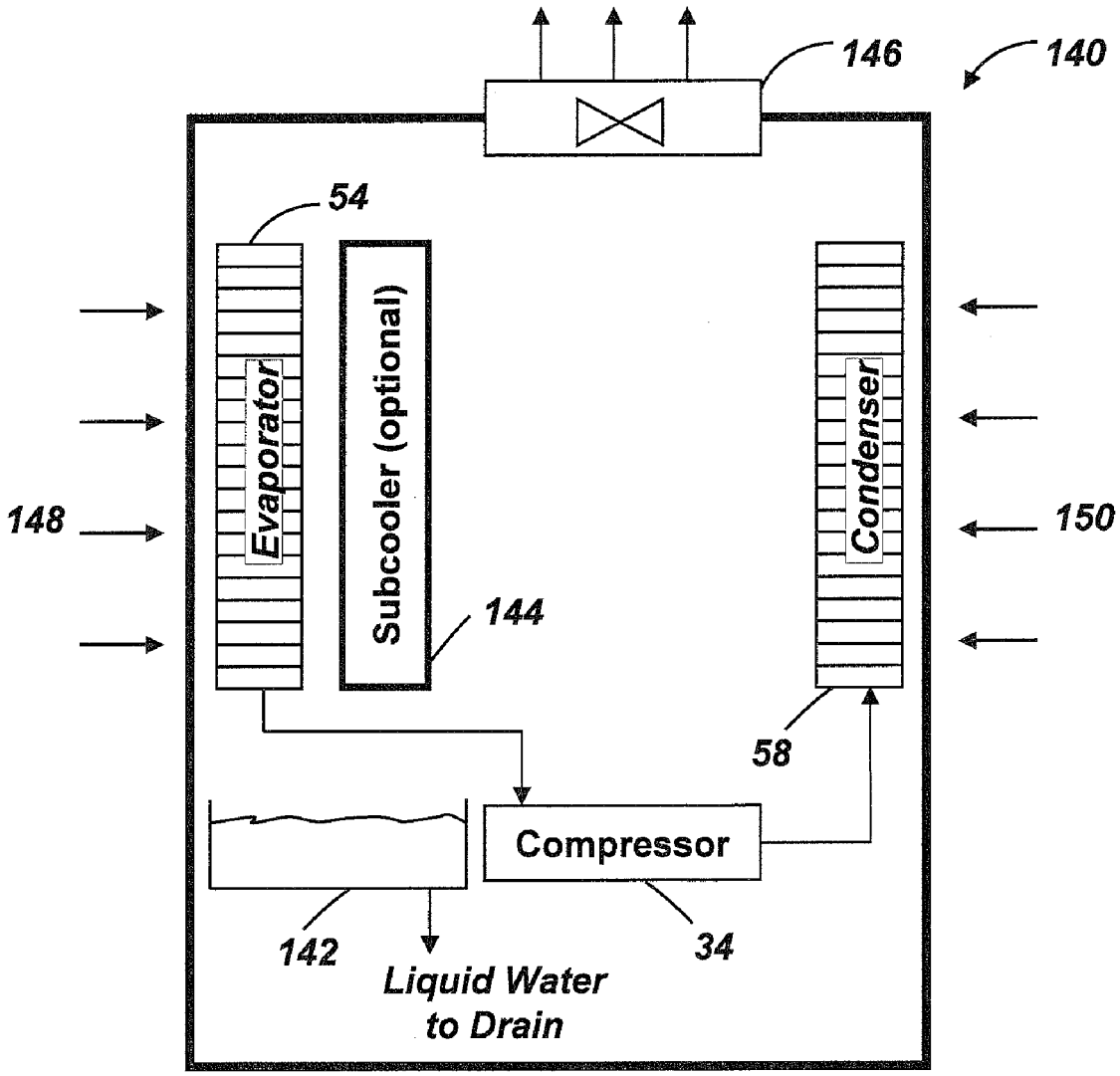
FIG. 11 is a schematic diagram of an embodiment of a dehumidification system in which gas streams introduced to an evaporator and to a condenser are separated.

FIG. 11 shows a dehumidification system 140 in which air flows to an evaporator and a condenser are separated. As shown, system 140 includes an evaporator 54, a condenser 58, and a compressor 34 connecting the evaporator and the condenser. Water condensed from evaporator 54 is collected in condensate pan 142. System 140 further includes an optional sub-cooling unit 144 downstream of evaporator 54, and a fan 146 configured to supply dehumidified gas to a selected environment.

During use, two separate gas streams are flowed through evaporator 54 and condenser 58, and fan 146 delivers the gas streams exiting the evaporator and the condenser to the selected environment. More specifically, a first gas stream 148 (e.g., air) passes through evaporator 54 and, in some embodiments, then passes through sub-cooling unit 144. Sub-cooling unit 144 takes refrigerant that is condensed or nearly condensed and reduces its temperature prior to introducing it into an expansion device (not shown), thereby taking advantage of the low temperature of the gas stream exiting evaporator 54. The gas stream that exits evaporator 54 (or sub-cooling unit 144, if applicable) does not pass through condenser 58. Rather, condenser 58 is cooled with a second gas stream 150 (e.g., ambient air) that is separate from first gas stream 148. The gas stream that exits evaporator 54 (or sub-cooling unit 144, if applicable), and the gas stream that exits condenser 58 are then delivered from system 140 by fan 146 to the selected environment.

Figure 12:
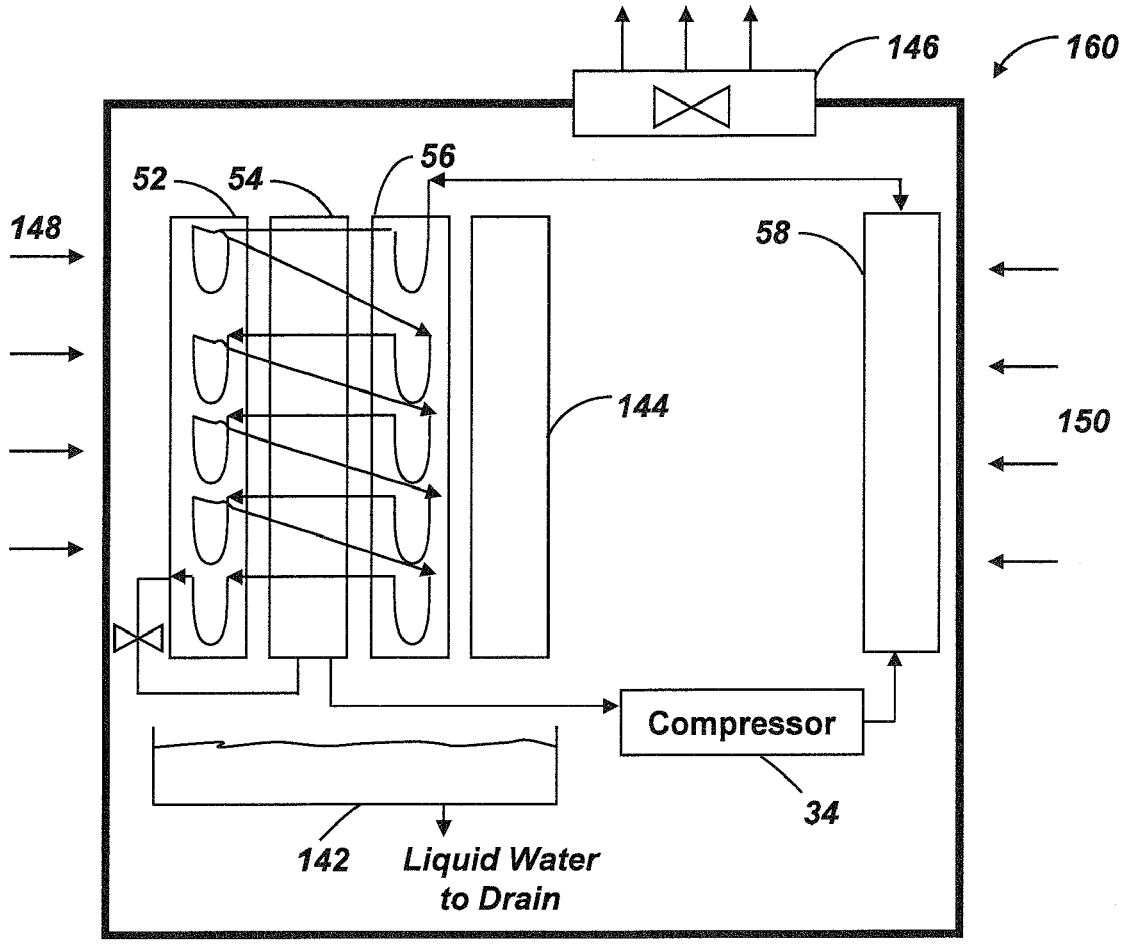
FIG. 12 is a schematic diagram of an embodiment of a dehumidification system in which gas streams introduced to an evaporator and to a condenser are separated, and further including recuperative cooling.

In some embodiments, separating gas flows to an evaporator and a condenser is applied to dehumidification systems having recuperative cooling, as described herein. FIG. 12 shows a system 160, which is similar to system 140, including a pre-cooling unit 52 upstream of evaporator 54 and a reheat unit 56 downstream of the evaporator. Pre-cooling and reheat units 52, 56 provide recuperative cooling as described above. Here, because the gas has been reheated by reheating unit 56, the temperature of the gas exiting the sub-assembly of pre-cooling unit 52/evaporator 54/ reheating unit 56 can be higher for a given amount of moisture removal than, for example, the temperature of the gas exiting an evaporator in certain dehumidification systems removing the same amount of moisture. As a result, there can be a greater need to reduce the increase in condenser temperature.

Like system 140, during use, two separate gas streams are flowed into system 160. More specifically, first gas stream 148 (e.g., air) passes through pre-cooling unit 52, then through evaporator 54, then through reheating unit 56, and then through optional sub-cooling unit 144. The gas stream that exits reheating unit 56 (or sub-cooling unit 144, if applicable) does not pass through condenser 58. Rather, condenser 58 is cooled with a second gas stream 150 (e.g., ambient air) that is separate from first gas stream 148. The gas stream that exits reheating unit 56 (or sub-cooling unit 144, if applicable), and the gas stream that exits condenser 58 are then delivered from system 160 by fan 146 to the selected environment.

Figure 13:
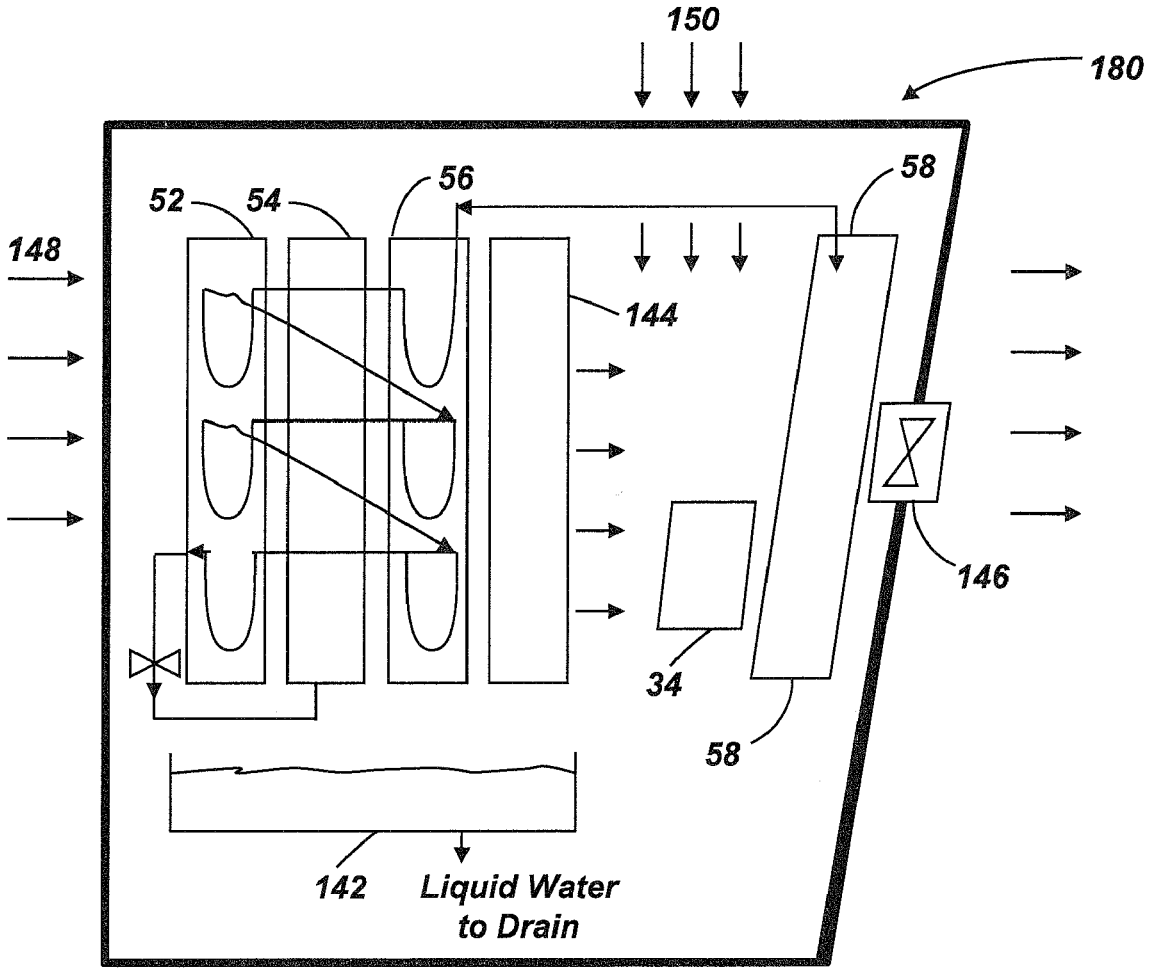
FIG. 13 is a schematic diagram of an embodiment of a dehumidification system.

While the condensers in systems 150 and 160 are cooled with a gas stream separate from a gas stream introduced to the evaporators, in other embodiments, a condenser is cooled with a mixture of gas streams. FIG. 13 shows a dehumidification system 180 that is similar to system 160, except that condenser 58 is cooled with a mixture of two gas streams 148, 150. In some embodiments, fan 58 may not be afforded a pressure drop reduction that may be possible in system 160, and a blower may substitute for the fan. In some embodiments, second gas stream 150 is routed through the same air filter that is used for first gas stream 148, and is allowed to bypass around the sides of the sub-assembly of pre-cooling unit 52/evaporator 54/reheat unit 56/sub-cooling unit 144 (if applicable). The heat exchanger loads can be selected such that the temperature of the gas exiting reheating unit 56 or sub-cooling unit 144 is approximately equal the temperature of second gas stream (e.g., ambient air).

During use, two separate gas streams 148, 150 are flowed into system 180. More specifically, first gas stream 148 (e.g., air) passes through pre-cooling unit 52, then through evaporator 54, then through reheating unit 56, and then through optional sub-cooling unit 144. The gas stream that exits reheating unit 56 (or sub-cooling unit 144, if applicable) then passes through condenser 58 to cool the condenser. Concurrently, condenser 58 is cooled with a second gas stream 150 (e.g., ambient air) that does not pass through the sub-assembly of pre-cooling unit 52/evaporator 54/reheating unit 56/sub-cooling unit 144 (if applicable), although the two gas stream 148, 150 can mix prior to passing through the condenser. The gas stream that exits condenser 58 is then delivered from system 180 by fan 146 or a blower to the selected environment.

In some embodiments, a plurality of pre-cooling and reheating units is included in the dehumidification systems and methods described herein. Alternatively or additionally, a suction line heat exchanger can be included to further increase liquid sub-cooling and system capacity.

In some embodiments, all of the heat extracted from a gas stream by the evaporator and the pre-cooling unit, as well as all of the compression heat, is added back to the gas stream as it leaves a system. In other embodiments, a remote condenser is used, for example, to reduce or to prevent addition of this heat to a space in which a dehumidification unit is located.

A dehumidification system can include a suction line accumulator and/or a liquid receiver to provide refrigerant storage space to allow the system to adapt to different operating conditions.

A gas mover (such as a blower or a fan) can be placed, for example, to move process gas at a location upstream of a heat exchanger assembly, downstream, and/or in between the evaporator and the reheat unit. Placement in cooler gas can enhance fan performance, but can add fan heat to the process gas prior to an evaporator. Placement upstream of an evaporator can increase gas pressure as it passes through the evaporator, thus increasing the saturation humidity ratio and enhancing water removal, but this placement also can add fan heat that is then removed by the evaporator.

In some embodiments, for example, when a dehumidification unit is used to provide water, heating of the water can be provided by a de-superheating coil immersed in and/or wrapped around a storage tank. To allow this coil to be active when heat is wanted, a valve (e.g., a three-way solenoid valve) can be used. To prevent the coil from filling with liquid refrigerant during bypass of the coil, a downstream check valve can be used.

Additional cooling for stored water can be provided by an evaporating coil in thermal contact with the stored water to which is supplied evaporating refrigerant, e.g., with a three-way solenoid valve that allows refrigerant to flow only when cooling is wanted.

The foregoing description and drawings are by way of example only. For example, illustrative embodiments can be used in a dedicated dehumidifier, in an air conditioner or in a heat pump (devices that are designed to cool air within a space). Also, although the pre-cooling and reheating units are exemplified by coils, these units can have other forms, such as microchannels and those used in dehumidification systems.

The phraseology and terminology used herein is for the purpose of description and should not be regarded as limiting. The use of "including," "comprising," "having," "containing," "involving", and variations thereof herein, encompasses the items listed thereafter and equivalents thereof as well as additional items.

All references, such as patents, patent applications, and publications, referred to above are incorporated by reference in their entirety.

Other embodiments are within the scope of the following claims.

What is claimed is:

1. A method for dehumidification, comprising:

introducing a refrigerant directly from a condenser to a heating unit;

introducing the refrigerant from the heating unit to a cooling unit along a first path;

introducing the refrigerant from the cooling unit to the heating unit along a second path different from the first path;

introducing the refrigerant from the heating unit to the cooling unit along a third path different from the first path;

contacting the cooling unit and the heating unit with a first gas stream; and further comprising condensing a liquid from a first gas stream by providing an evaporator between the cooling unit and the heating unit, the liquid condensing between the cooling unit and the heating unit along a flow path of the first gas stream.

2. The method of claim 1, further comprising heating the first gas stream after the first gas stream contacts the heating unit.

3. The method of claim 1, further comprising a step of preventing introduction of the refrigerant from the condenser to the heating unit.

4. The method of claim 1, further comprising introducing the refrigerant from the cooling unit to an expansion device.

5. The method of claim 1, further comprising introducing the refrigerant from the heating unit to an expansion device.

6. The method of claim 1, further comprising collecting a condensed liquid.

7. The method of claim 1, further comprising introducing the refrigerant from the cooling unit to the heating unit along a fourth path different from the second path.

8. The method of claim 1, comprising, in sequence, contacting the cooling unit with the first gas stream, condensing a liquid from the first gas stream, contacting the heating unit with the first gas stream, and heating the first gas stream.

9. The method of claim 1, further comprising cooling the condenser with a second gas stream different from the first gas stream.

10. The method of claim 1, further comprising cooling the condenser with the first gas stream.

11. The method of claim 1, wherein the first gas stream does not substantially cool the condenser.

12. The method of claim 1, comprising flowing the refrigerant between the heating unit and the cooling unit for three or more cycles.

* * * * *